US007597140B2

(12) United States Patent
Filippov et al.

(10) Patent No.: US 7,597,140 B2
(45) Date of Patent: Oct. 6, 2009

(54) EXPANSION DEVICE FOR EXPANDING A PIPE

(75) Inventors: Andrei Gregory Filippov, Katy, TX (US); Neil Philip Thomson, Rijswijk (NL)

(73) Assignee: Shell Oil Company, Houston, TX (US)

( * ) Notice: Subject to any disclaimer, the term of this patent is extended or adjusted under 35 U.S.C. 154(b) by 268 days.

(21) Appl. No.: 10/555,476

(22) PCT Filed: May 3, 2004

(86) PCT No.: PCT/EP2004/050681

§ 371 (c)(1),
(2), (4) Date: Jul. 5, 2006

(87) PCT Pub. No.: WO2004/099561

PCT Pub. Date: Nov. 18, 2004

(65) Prior Publication Data

US 2006/0260802 A1 Nov. 23, 2006

(30) Foreign Application Priority Data

May 5, 2003 (EP) ..... 03076311

(51) Int. Cl.
*E21B 23/02* (2006.01)

(52) U.S. Cl. ..... 166/207; 166/277; 166/380

(58) Field of Classification Search ..... 166/207, 166/277, 380

See application file for complete search history.

(56) References Cited

U.S. PATENT DOCUMENTS

| | | | | |
|---|---|---|---|---|
| 1,393,620 | A | | 10/1921 | Gavin |
| 1,494,128 | A | | 5/1924 | Primrose |
| 1,583,187 | A | | 5/1926 | Schumacher |
| 1,982,400 | A | | 11/1934 | Riemenschneider et al. ..... 29/153.1 |
| 2,160,263 | A | | 5/1939 | Fletcher ..... 29/148.2 |
| 2,259,232 | A | | 10/1941 | Stone ..... 308/4 |
| 2,357,123 | A | | 8/1944 | Maxwell ..... 153/80.5 |
| 2,761,205 | A | | 9/1956 | Siklosi ..... 29/447 |
| 2,812,025 | A | * | 11/1957 | Doherty et al. ..... 166/207 |
| 3,023,178 | A | | 2/1962 | Greenlee et al. ..... 260/22 |
| 3,067,801 | A | | 12/1962 | Sortor ..... 153/80 |
| 3,179,168 | A | * | 4/1965 | Vincent ..... 166/277 |
| 3,191,677 | A | | 6/1965 | Kinley ..... 166/14 |
| 3,191,680 | A | * | 6/1965 | Vincent ..... 166/387 |
| 3,203,451 | A | * | 8/1965 | Vincent ..... 138/143 |
| 3,203,483 | A | | 8/1965 | Vincent ..... 166/207 |

(Continued)

FOREIGN PATENT DOCUMENTS

DE 10028015 A1 6/1999

(Continued)

OTHER PUBLICATIONS

Intl Search Report dated Jul. 16, 2004 (PCT/EP2004/050681).

(Continued)

*Primary Examiner*—Jennifer H Gay
*Assistant Examiner*—Nicole A Coy

(57) ABSTRACT

A pipe expansion device having an expansion cone tapering in forward direction, a cone-guide, an actuator for displacing the expansion cone and the elongated cone-guide relative to each other, a retrievable end anchor, and a middle anchor joined to the expansion cone.

9 Claims, 3 Drawing Sheets

U.S. PATENT DOCUMENTS

| | | | | | |
|---|---|---|---|---|---|
| 3,502,150 | A | | 3/1970 | Dunlap | 166/315 |
| 3,583,200 | A | | 6/1971 | Cvijanovic | 72/393 |
| 3,667,252 | A | | 6/1972 | Nelson | 64/23.5 |
| 3,669,190 | A | | 6/1972 | Sizer et al. | 166/315 |
| 3,691,624 | A | | 9/1972 | Kinley | 29/523 |
| 3,712,376 | A | * | 1/1973 | Owen et al. | 166/277 |
| 3,746,091 | A | | 7/1973 | Owen et al. | 166/207 |
| 4,214,358 | A | | 7/1980 | Clerc | 29/520 |
| 4,253,687 | A | | 3/1981 | Maples | 285/332.3 |
| 4,262,518 | A | | 4/1981 | Creger et al. | 72/393 |
| 4,429,904 | A | | 2/1984 | Reimert | 285/24 |
| 4,483,399 | A | | 11/1984 | Colgate | 166/308 |
| 4,525,001 | A | | 6/1985 | Lumsden et al. | 285/328 |
| 4,611,838 | A | | 9/1986 | Heilmann et al. | 285/331 |
| 4,629,221 | A | | 12/1986 | Lumsden et al. | 285/328 |
| 4,648,627 | A | | 3/1987 | Reimert | 285/24 |
| 4,875,710 | A | | 10/1989 | Mercado | 285/24 |
| 5,017,160 | A | | 5/1991 | Garcia | 439/750 |
| 5,348,095 | A | | 9/1994 | Worrall et al. | 166/380 |
| 5,366,012 | A | | 11/1994 | Lohbeck | 166/277 |
| 5,513,703 | A | | 5/1996 | Mills et al. | 166/55.1 |
| 5,613,557 | A | | 3/1997 | Blount et al. | 166/277 |
| 5,785,120 | A | | 7/1998 | Smalley et al. | 166/55 |
| 5,964,486 | A | | 10/1999 | Sinclair | 285/331 |
| 5,971,443 | A | | 10/1999 | Noel et al. | 285/94 |
| 6,012,523 | A | * | 1/2000 | Campbell et al. | 166/277 |
| 6,029,748 | A | * | 2/2000 | Forsyth et al. | 166/380 |
| 6,047,997 | A | | 4/2000 | Olivier | 285/333 |
| 6,098,717 | A | | 8/2000 | Bailey et al. | 166/382 |
| 6,142,230 | A | * | 11/2000 | Smalley et al. | 166/277 |
| 6,325,148 | B1 | * | 12/2001 | Trahan et al. | 166/297 |
| 6,352,112 | B1 | | 3/2002 | Mills | 166/277 |
| 6,354,372 | B1 | | 3/2002 | Carisella et al. | 166/118 |
| 6,354,373 | B1 | | 3/2002 | Vercaemer et al. | 166/277 |
| 6,450,261 | B1 | | 9/2002 | Baugh | 166/277 |
| 6,454,493 | B1 | | 9/2002 | Lohbeck | 405/184.2 |
| 6,460,615 | B1 | | 10/2002 | Heijnen | 166/55 |
| 6,497,289 | B1 | | 12/2002 | Cook et al. | 166/380 |
| 6,557,640 | B1 | | 5/2003 | Cook et al. | 166/380 |
| 6,561,227 | B2 | | 5/2003 | Cook et al. | 138/98 |
| 6,568,471 | B1 | | 5/2003 | Cook et al. | 166/177.4 |
| 6,568,472 | B1 | | 5/2003 | Gano et al. | 166/207 |
| 6,622,789 | B1 | | 9/2003 | Braddick | 166/277 |
| 6,688,397 | B2 | | 2/2004 | McClurkin et al. | 166/380 |
| 6,691,777 | B2 | | 2/2004 | Murray et al. | 166/216 |
| 6,695,065 | B2 | | 2/2004 | Simpson et al. | 166/384 |
| 6,712,401 | B2 | | 3/2004 | Coulon et al. | 285/331 |
| 6,719,064 | B2 | | 4/2004 | Price-Smith et al. | 166/387 |
| 6,722,427 | B2 | | 4/2004 | Gano et al. | 166/217 |
| 6,799,637 | B2 | | 10/2004 | Schetky et al. | 166/384 |
| 6,860,329 | B1 | * | 3/2005 | Oosterling | 166/298 |
| 7,007,760 | B2 | | 3/2006 | Lohbeck | 166/384 |
| 7,040,018 | B2 | | 5/2006 | Nijveld et al. | |
| 7,111,679 | B2 | | 9/2006 | Lohbeck et al. | |
| 7,117,940 | B2 | | 10/2006 | Campo | |
| 7,128,146 | B2 | | 10/2006 | Baugh et al. | 166/206 |
| 7,131,498 | B2 | | 11/2006 | Campo | |
| 7,140,428 | B2 | | 11/2006 | Campo | |
| 7,140,430 | B2 | | 11/2006 | Wubben | |
| 7,182,141 | B2 | | 2/2007 | Tran et al. | 166/384 |
| 7,185,701 | B2 | * | 3/2007 | Mackenzie | 166/297 |
| 7,360,604 | B2 | | 4/2008 | Lohbeck et al. | 166/384 |
| 7,380,593 | B2 | | 6/2008 | Lohbeck | |
| 7,389,822 | B2 | | 6/2008 | Lohbeck et al. | 166/384 |
| 7,401,650 | B2 | * | 7/2008 | MacKenzie | 166/297 |
| 2002/0033262 | A1 | | 3/2002 | Musselwhite et al. | 166/285 |
| 2002/0104647 | A1 | | 8/2002 | Lawrence | 166/55.1 |
| 2003/0150608 | A1 | | 8/2003 | Smith, Jr. et al. | 166/118 |
| 2003/0178204 | A1 | | 9/2003 | Echols et al. | 166/386 |
| 2003/0192703 | A1 | | 10/2003 | Williams et al. | 166/376 |
| 2003/0192704 | A1 | | 10/2003 | Ford et al. | 166/377 |
| 2004/0159446 | A1 | | 8/2004 | Haugen et al. | 166/384 |
| 2004/0168796 | A1 | | 9/2004 | Baugh et al. | 166/207 |
| 2005/0000686 | A1 | | 1/2005 | Lohbeck | 166/207 |
| 2005/0045342 | A1 | | 3/2005 | Luke et al. | 166/384 |
| 2005/0056433 | A1 | | 3/2005 | Ring et al. | |
| 2005/0056434 | A1 | | 3/2005 | Watson et al. | 166/384 |
| 2005/0115719 | A1 | | 6/2005 | Abercrombie Simpson et al. | 166/383 |
| 2005/0173129 | A1 | | 8/2005 | Oosterling et al. | 166/382 |
| 2005/0194127 | A1 | | 9/2005 | Campo | |
| 2006/0191691 | A1 | | 8/2006 | Lohbeck | |
| 2006/0196679 | A1 | | 9/2006 | Brisco et al. | 166/384 |
| 2006/0231249 | A1 | | 10/2006 | Lohbeck | |

FOREIGN PATENT DOCUMENTS

| | | | |
|---|---|---|---|
| EP | 0386895 | A1 | 9/1990 |
| EP | 643794 | | 3/1995 |
| EP | 0952305 | A1 | 10/1999 |
| EP | 0952306 | A1 | 10/1999 |
| EP | 0957233 | A2 | 11/1999 |
| EP | 0881354 | A3 | 3/2000 |
| EP | 1306519 | A2 | 5/2003 |
| FR | 1489013 | | 6/1967 |
| GB | 2356651 | A | 5/2001 |
| GB | 2392686 | A | 3/2004 |
| GB | 2398312 | A | 8/2004 |
| GB | 2399848 | | 9/2004 |
| GB | 2399858 | A | 9/2004 |
| GB | 2401131 | A | 11/2004 |
| JP | 59197323 | | 11/1984 |
| SU | 859596 | | 9/1981 |
| SU | 1745873 | A1 | 7/1992 |
| WO | WO9325799 | | 12/1993 |
| WO | WO9325800 | | 12/1993 |
| WO | WO9637680 | | 11/1996 |
| WO | WO9800626 | | 1/1998 |
| WO | WO9822690 | | 5/1998 |
| WO | WO9935368 | | 7/1999 |
| WO | WO0026500 | | 5/2000 |
| WO | WO0026502 | | 5/2000 |
| WO | WO0066929 | | 11/2000 |
| WO | WO0104520 | A1 | 1/2001 |
| WO | WO0120125 | A1 | 3/2001 |
| WO | 01/98623 | | 12/2001 |
| WO | WO0201102 | A1 | 1/2002 |
| WO | WO0223007 | A1 | 3/2002 |
| WO | WO0229199 | A1 | 4/2002 |
| WO | WO02052124 | A2 | 7/2002 |
| WO | WO02053867 | A2 | 7/2002 |
| WO | WO02059456 | A1 | 8/2002 |
| WO | 02/086285 | | 10/2002 |
| WO | WO02086286 | A2 | 10/2002 |
| WO | WO03006788 | A1 | 1/2003 |
| WO | WO03010414 | A1 | 2/2003 |
| WO | WO03015954 | A1 | 2/2003 |
| WO | WO03016669 | A2 | 2/2003 |
| WO | WO03023178 | A2 | 3/2003 |
| WO | WO03069115 | A2 | 8/2003 |
| WO | WO2004007892 | A2 | 1/2004 |
| WO | WO2004027205 | A2 | 4/2004 |
| WO | WO2004079150 | A2 | 9/2004 |
| WO | WO2004079157 | A1 | 9/2004 |
| WO | WO2004081346 | A2 | 9/2004 |

OTHER PUBLICATIONS

Intl Preliminary Report on Patentability (PCT/EP2004/050681).
Extrait de la brochure World Oil's, 1998 Tubing Reference Tables—Gulf Publishing Company.
Extrait du Catalogue VAM No. 940 publie par Vallourec Oil and Gas.

* cited by examiner

EXPANSION DEVICE FOR EXPANDING A PIPE

PRIORITY CLAIM

The present application claims priority on European Patent Application 03076311.4 filed May 5, 2003.

FIELD OF THE INVENTION

The present invention relates to an expansion device for expanding a pipe.

BACKGROUND OF THE INVENTION

An example of an expansion device for expanding a pipe is disclosed in International patent application publication No. 02/086 285. This publication discloses an expansion device having a front end and a rear end and it comprises an expansion cone tapering in forward direction towards the front end of the expansion device, a set of guide rods, an actuator capable of displacing, during normal operation, the expansion cone and the set of guide rods relative to each other, and two one-directional end anchors arranged at either end of the set of guide rods, which end anchors are capable of cooperating with the inner surface of the pipe to prevent movement of the set of guide rods relative to the pipe, when during normal operation, the expansion cone is displaced relative to the guide rods in the forward direction.

The known expansion device is, during normal operation, attached to the lower end of a tubular.

Normal operation of known expansion devices comprises two steps, an expansion step and a reset step. The initial position of the expansion step is that the end anchors are set, wherein the end anchor at the front is set in the unexpanded part of the pipe and anchor at the back is set in the part of the pipe that has been expanded, and wherein the expansion cone is in a first position close to the end anchor. The actuator is powered so as to force the expansion cone in forward direction to expand the pipe, during expansion the end anchors take up the axial force. The actuator is powered by fluid under pressure supplied through the tubular to which the expansion device is attached. When the anchor has arrived at the front anchor, powering the actuator is interrupted and the displacement of the expansion cone stops.

Resetting the expansion cone is done by pushing the tubular in order to move the expansion device forwards. The end anchors do not prevent this displacement, because they work in one direction only. The expansion cone cannot move forwards, so that the guide rods are displaced forwards relative to the expansion cone. When the end anchor at the back has arrived at the expansion cone, the displacement of the guide rods is interrupted and the expansion device has returned to its initial state. At the start of expanding a pipe, the front anchor can be set in the unexpanded pipe section, whilst the back anchor has no expanded pipe in which it can set. On completing the expansion, the back anchor can be set in the expanded pipe section, whilst the front anchor extends out of the pipe.

SUMMARY OF THE INVENTION

According to some embodiments of the present invention, the expansion device has a front end and a rear end, and comprises an expansion cone tapering in forward direction towards the front end of the expansion device, an anchor capable of being selectively anchored to the inner surface of the pipe, an actuator for moving the expansion cone in forward direction through the pipe, the actuator including a first member connected to the expansion cone, a second member axially movable relative to the first member, the second member being connected to the anchor, and hydraulic drive means for axially moving the first and second members relative to each other, wherein the hydraulic drive means is adapted to move the expansion cone in forward direction through the pipe when the anchor is anchored to the inner surface of the pipe, and wherein the hydraulic drive means is adapted to move the first and second members relative to each other so as to move the anchor in forward direction through the pipe when the anchor is released from the inner surface of the pipe.

BRIEF DESCRIPTION OF THE DRAWINGS

The embodiments of the invention will now be described by way of example in more detail with reference to the accompanying drawing, wherein.

DETAILED DESCRIPTION OF THE INVENTION

Figure 1:
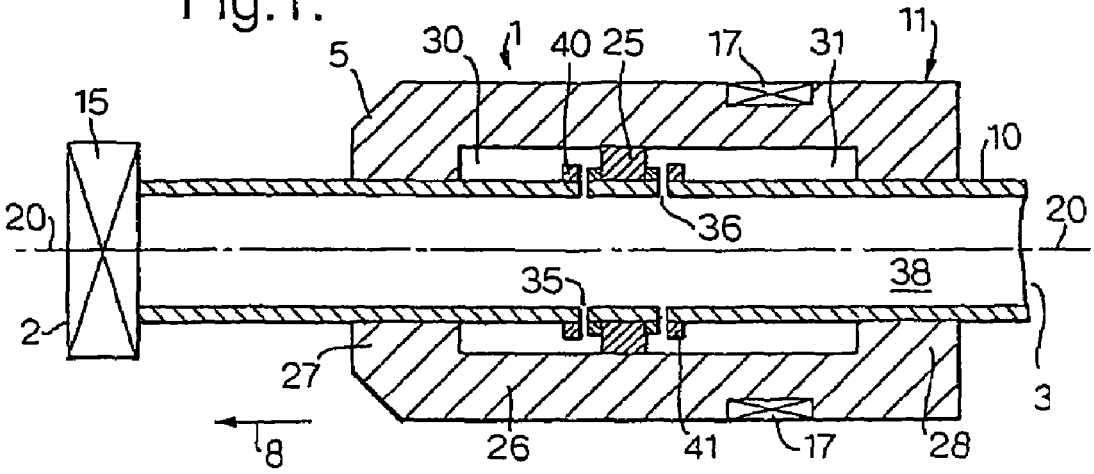
FIG. 1 shows schematically and not to scale an expansion device according to the present invention.

Reference is now made to FIG. 1. The expansion device 1 for expanding a pipe (not shown) according to one embodiment of the present invention has a front end 2 and a rear end 3. The expansion device 1 comprises an expansion cone 5 tapering in forward direction 8 towards the front end 2 of the expansion device 1, a second member in the form of an elongated cone-guide 10, and an actuator 11 capable of displacing, during normal operation, the expansion cone 5 and the elongated cone-guide 10 relative to each other between a first state and a second state.

The expansion device 1 further comprises a retrievable end anchor 15 arranged at an end (the front end 2) of the elongated cone-guide 10. The end anchor 15 is capable of cooperating with the inner surface of the pipe (not shown) to prevent movement of the elongated cone-guide 10 relative to the pipe, when, during normal operation, the expansion cone 5 is displaced relative to the elongated cone-guide 10 in the forward direction 8. In addition the expansion device 1 suitably comprises a middle anchor 17 joined to the expansion cone 5. The middle anchor 17 is capable of cooperating with the inner surface of the pipe (not shown) to prevent movement of the expansion cone 5 relative to the pipe, when, during normal operation, the elongated cone-guide 10 is displaced relative to the expansion cone 5 in the forward direction 8. The anchors 15 and 17 are one-directional anchors, or they can be settable anchors that are only set to prevent displacement in an undesired direction.

The elongated cone-guide 10 is a tube, having a central longitudinal axis 20.

The actuator 11 includes a hydraulic drive means including an annular piston 25 protruding from the elongated cone-guide 10, and a first member connected to the expansion cone 5 in the form of a cylinder 26 slidingly arranged over the piston 25. The hydraulic drive means for axially moving the first and second members relative to each other is adapted to move the expansion cone in forward direction through the pipe when the anchor is anchored to the inner surface of the pipe, to move the first and second members relative to each other so as to move the anchor in forward direction through the pipe when the anchor is released from the inner surface of the pipe.

The cylinder 26 has annular sealing rims 27 and 28 at either end of the cylinder 26, which define a front chamber 30 and a rear chamber 31, respectively. The actuator 11 further includes a fluid supply for alternatingly supplying pressure fluid to the front chamber 30 to displace the expansion cone 5 in forward direction relative to the elongated cone-guide 10 and to the rear chamber 31 to displace the elongated cone-guide 10 in forward direction relative to the expansion cone 5.

The fluid supply includes a front passage 35 arranged near the front of the annular piston 25, a rear passage 36 arranged near the rear of the annular piston 25, and a flow control means (not shown) for allowing or preventing pressure fluid from flowing through the front passage 35 or through the rear passage 36 into the respective chamber 30 or 31.

Allowing pressure fluid to enter from the interior 38 of the elongated cone-guide 10 via the rear passage 36 into the rear chamber 31 causes the elongated cone-guide 10 to move in forward direction 8 relative to the expansion cone 5. The forward movement is stopped when a front stop 40 touches the front annular sealing rim 27. This position is the first state. Allowing pressure fluid to enter from the interior 38 of the elongated cone-guide 10 via the front passage 35 into the front chamber 30 causes the expansion cone 5 to move in forward direction 8 relative to the elongated cone-guide 10. The forward movement is stopped when the rear annular sealing rim 28 touches a rear stop 41. This position is the second state.

Pressure fluid is supplied to the interior 38 through a suspension pipe (not shown). The wall of the cylinder 26 is provided with outlets (not shown) having a suitable valve (not shown) to allow draining of fluid from the chambers 30 and 31.dc In the above-described embodiment of the invention, the actuator 11 included a single annular piston 25 protruding from the elongated cone-guide 10 and a cylinder 26 slidingly arranged over the piston 25 having two chambers 30 and 31. It will be understood that the actuator can as well have more than one annular piston and that the cylinder can have more than one chamber (two chambers per piston).

When the expansion device is in the first state, it can start an expansion stroke. At the end of the expansion stroke, the expansion device is in the second state and it can start a reset stroke. This sequence will now be discussed with reference to FIG. 2.

Figure 2A:
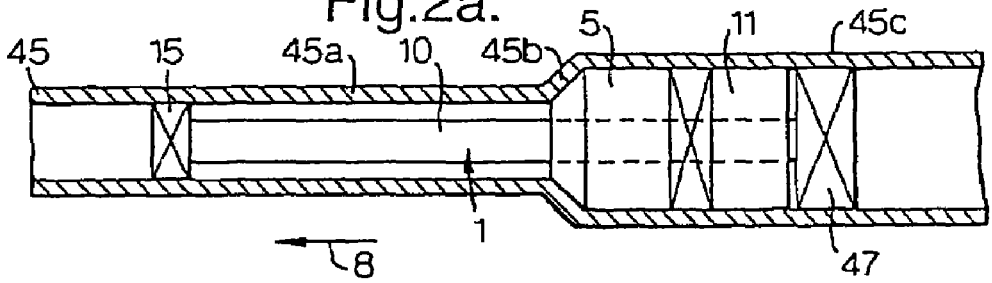
FIG. 2 shows schematically three stages of the normal operation of the expansion device of FIG. 1.
Figure 2B:
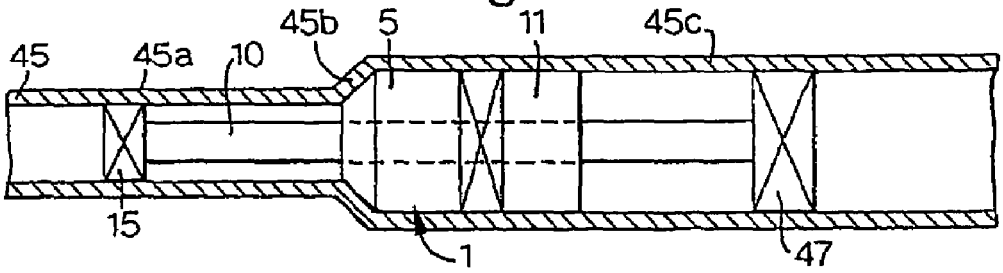
Figure 2C:
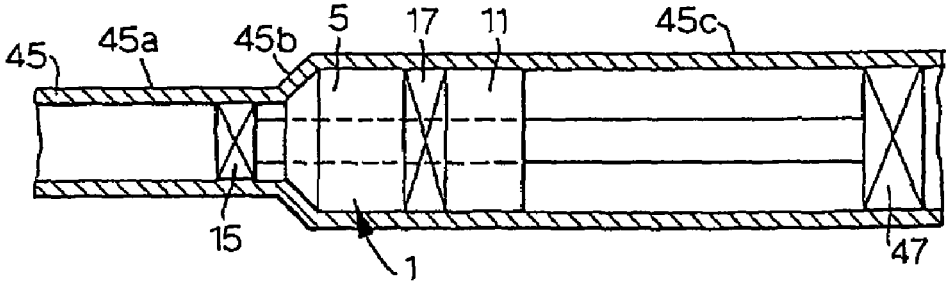

FIGS. 2*a*, 2*b* and 2*c* show schematically a partial sectional view of the expansion device 1 according to the one embodiment of the present invention is arranged in a pipe 45 that is being expanded. Parts already discussed with reference to the previous Figures have got the same reference numerals.

The pipe 45 comprises three sections, an unexpanded section 45*a*, and expanding section 45*b* and an expanded section 45*c*. In addition to the front anchor 15 the expansion device 1 is provided with a second retrievable anchor in the form of rear anchor 47. The second retrievable, one-directional end anchor 47 is arranged at the rear of the elongated cone-guide 10, and the end anchor 47 is capable of cooperating with the inner surface of the pipe 45 to prevent movement of the elongated cone-guide 10 relative to the pipe 45, when, during normal operation, the expansion cone 5 is displaced relative to the elongated cone-guide 10 in the forward direction 8. The anchor 47 is a one-directional anchor, or it can be a settable anchor that is only set to prevent displacement in an undesired direction.

FIG. 2*a* shows the first stage, start of the expansion stroke, of the expansion method with the expansion device according to one embodiment of the invention.

At start of the expansion stroke, the expansion device 1 is anchored in the pipe 45 by means of the rear anchor 47 in pipe section 45*c* and the front anchor 15 in pipe section 45*a*. The expansion device 1 is the first state and the actuator 11 is actuated, such that the expansion cone 5 is displaced in forward direction 8 to expand the pipe 45. This is done by supplying pressure fluid to the front chamber 30 (see FIG. 1), and allowing fluid to drain from the rear chamber 31. The end anchors 47 and 15 cooperate with the inner surface of the pipe 45 to prevent movement of the elongated cone-guide 10 relative to the pipe 45.

FIG. 2*b* shows an intermediate stage in the expansion process.

FIG. 2*c* shows the end of the expansion stroke, when the expansion device 1 is in the second state. At the end of the expansion stroke, the reset stroke is started. In the reset stroke the actuator 11 is actuated so as to displace the elongated cone-guide 10 in forward direction relative to the expansion cone 5. This is done by supplying pressure fluid to the rear chamber 31 (see FIG. 1), and allowing fluid to drain from the front chamber 30. Because the end anchors 47 and 15 are one-directional anchors, they do not fix the elongated cone-guide 10 when the elongated cone-guide 10 is displaced in forward direction 8 relative to the expansion cone 5. During the reset stroke, the middle anchor 17 prevents the expansion cone 5 from moving backwards.

Having returned the expansion device to the first state as shown in FIG. 2*a*, the expansion stroke starts again. In this way an entire pipe can be expanded.

Figure 3A:
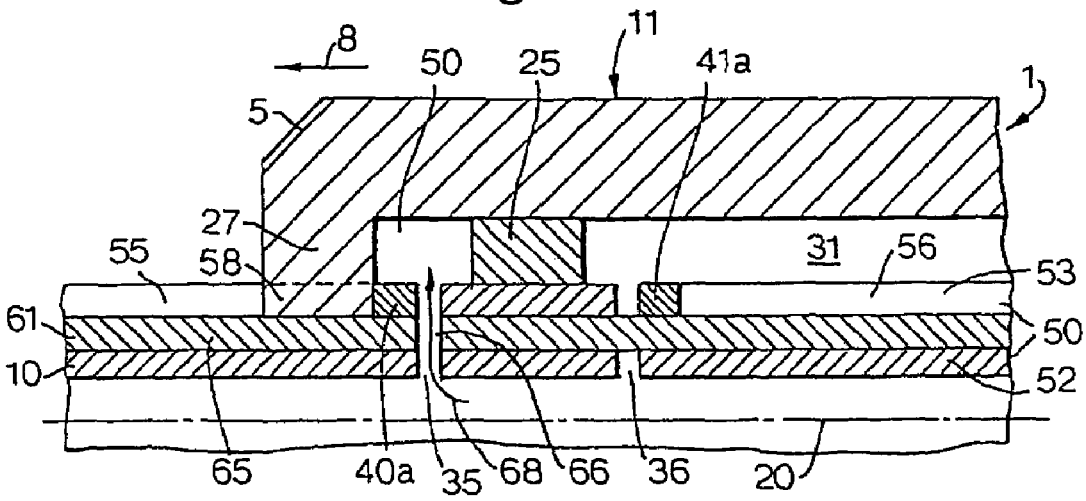
FIG. 3 shows schematically and not to scale a longitudinal section of an embodiment of the actuator of the expansion device according to the present invention.
Figure 3B:
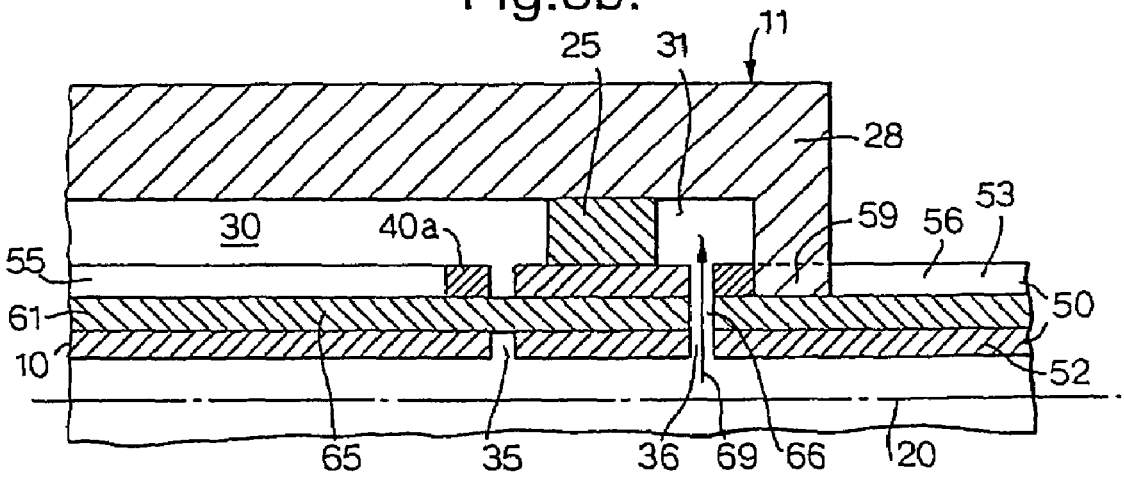

Reference is now made to FIGS. 3*a* and 3*b* showing schematically and not to scale a longitudinal section of a suitable embodiment of the upper half of part of the actuator 11 of the expansion device 1 according to the present invention. Parts already discussed with reference to the previous Figures have got the same reference numerals. The pressure fluid supply will now be discussed in more detail.

The elongated cone-guide 10 is a double-walled tube 50, having an inner wall 52 and an outer wall 53. The passages 35 and 36 extend through the double-walled tube 50.

For reasons that will become clear when discussing FIG. 4, the outer wall 53 of the double-walled tube 50 is provided with axial slots, a front axial slot 55 extending from the front stop 40*a*, and a rear axial slot 56 extending from the rear stop 41*a*. The front annular sealing rim 27 and the rear annular sealing rim 28 is provided with wedges 58 and 59 respectively, that pass through the slots 55 and 56.

There is an annular chamber 61 between the walls 52 and 53 of the double-walled tube 50. The front passage 35 and the rear passage 36 extend through the walls 52 and 53 of the double-walled tube 50. The valve includes a sliding valve 65 arranged in the annular chamber 61, which sliding valve 65 is provided with a valve passage 66. The sliding valve 65 can be displaced between a front position in which the valve passage 66 is at the position of the front passage 35 and a rear position in which the valve passage 66 is at the position of the rear passage 36. The actuator 11 further includes driving means for displacing the sliding valve 65 between the front position and the rear position.

During normal operation, at the start of the expansion stroke the sliding valve 65 is in the position shown in FIG. 3*a*, wherein wedge 58 of the front annular sealing rim 27 is in contact with the stop 41*a*, at the end of the front axial slot 55. Pressure fluid is supplied from the interior of the double-walled tube 50 via the front passage 35 to the front chamber 30 (arrow 68). The fluid pressure causes displacement of the cylinder into forward direction 8. It will be understood that the expansion cone 5 is thus displaced in forward direction expanding the pipe (not shown). At the end of the expansion stroke, the wedge 59 of the rear annular sealing rim 28 is in contact with the rear stop 41*a*.

To begin the reset stroke, the sliding valve 65 is displaced to its rear position (see FIG. 3*b*). In the rear position, the valve passage 66 is at the position of the rear passage 36. Then pressure fluid is supplied from the interior of the double-walled tube 50 via the rear passage 36 to the rear chamber 31 (arrow 69). The fluid pressure causes displacement of the elongated cone-guide 10 into forward direction 8. To arrive at the position of FIG. 3*a*, which is the start of the expansion stroke.

Figure 4A:
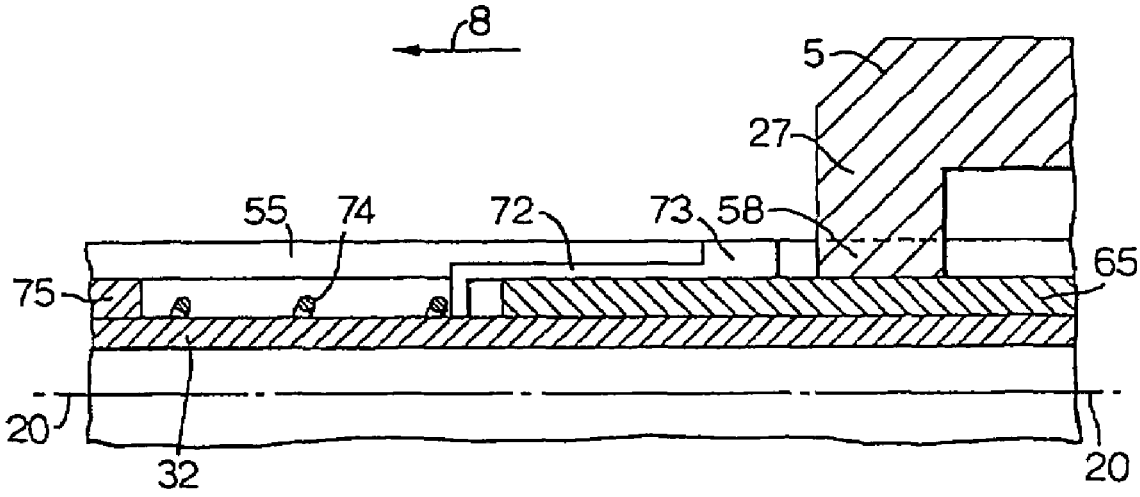
FIG. 4 shows schematically and not to scale a longitudinal section of an embodiment of driving means.
Figure 4B:
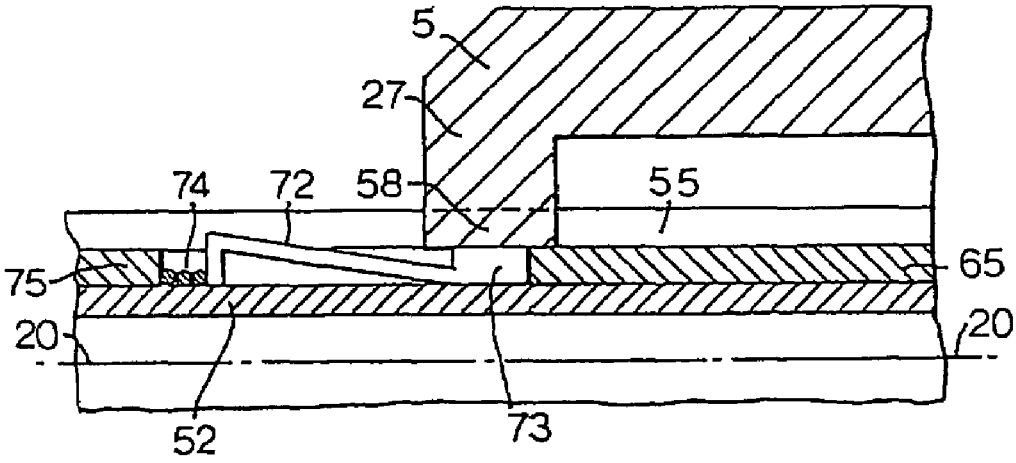

The expansion device according to one embodiment of the present invention includes a driving means, and reference is made to FIGS. 4*a* and 4*b* showing not to scale the front end driving means. Parts already discussed with reference to the previous Figures have got the same reference numerals.

The front end driving means includes a releasable pusher 72 having a head 73. The pusher 72 is spring-loaded by spring 74. The forward end of the spring 74 is resting against a front stop 75 that is fixed to the inner wall 52.

In FIG. 4*a* is shown that the expansion cone 5 moves in forward direction 8. The pusher 72 rests on the sliding valve 65, and the wedge 58 approaches the pusher 72. On touching (not shown), the expansion cone 5 moving further will compress the spring 74. When the expansion cone 5 moves further forwards, the spring 74 gets further compressed.

Reference is now made to FIG. 4*b*, showing a position in which the expansion cone 5 has moved to its farthest position (which corresponds to the position shown in FIG. 3*b*), wherein the head 73 of the pusher 72 is forced under the wedge 58 and wherein the spring 74 starts pushing back the sliding valve 65, until the sliding valve 65 is stopped by a similar pusher (not shown) at the rear end. Then the sliding valve 65 is in a position shown in FIG. 3*b*.

There is a similar driving means at the rear end (not shown).

The front stop 75 that is fixed to the inner wall 52 is suitably the joint between the inner wall 52 and the outer wall 53 of the double-walled tube 50.

When needed a guide (not shown) can be placed near the pusher 72 to direct the rear end of the pusher 72 under the approaching wedge 58.

The rear anchor 47 can be connected to the elongated cone-guide 10 with some axial play to allow for contraction of the pipe that is being expanded. There is provided a spring (not shown) to return the rear anchor 47 to its initial position. When the rear anchor 47 is connected with axial play to the elongated cone-guide, the front anchor may take up the axial reaction force associated with expanding the pipe.

In the embodiment discussed with reference to FIGS. 3 and 4, the axial slots 55 and 56 extended over a great length. In an alternative embodiment (not shown) the axial slots extend over a portion long enough to house the pusher 72. In this case the annular sealing rims 27 and 28 are thicker and not provided by wedges, and the head 73 of the pusher 72 extends out of the axial slot. The size of the annular sealing rim is so selected that it can push the head 73 under the rim and seal on the not-slotted section of the outer tube.

The expansion cone 5 may have any shape or design, provided that it can expand a pipe when being displaced into the pipe.

We claim:

1. An expansion device for expanding a pipe, wherein the expansion device has a front end and a rear end, and wherein the expanding device comprises:

an expansion cone tapering in forward direction towards the front end of the expansion device;

an anchor capable of being selectively anchored to the inner surface of the pipe; and an actuator for moving the expansion cone in forward direction through the pipe, the actuator comprising a first member connected to the expansion cone, a second member axially movable relative to the first member, the second member being connected to the anchor, and hydraulic drive means for axially moving the first and second members relative to each other, wherein the hydraulic drive means includes a front hydraulic chamber for moving the expansion cone in a forward direction through the pipe when it is desired to expand the pipe and a rear hydraulic chamber for moving the first and second members relative to each other so as to move the anchor in a forward direction through the pipe when it is desired to advance the anchor through the pipe.

2. The expansion device according to claim 1, wherein the second member is an elongated cone-guide, wherein the anchor is a retrievable end anchor arranged at one end of the elongated cone-guide which end anchor is capable of cooperating with the inner surface of the pipe to prevent movement of the elongated cone-guide relative to the pipe, when, during normal operation, the expansion cone is displaced relative to the elongated cone-guide in the forward direction, wherein the hydraulic drive means includes an annular piston protruding from the elongated cone-guide, wherein the first member is a cylinder slidingly arranged over the annular piston and having annular sealing rims at either end of the cylinder which define a front chamber and a rear chamber, respectively, and wherein the actuator includes a fluid supply for alternatingly supplying pressure fluid to the front chamber to displace the expansion cone in forward direction relative to the elongated cone-guide and to the rear chamber to displace the elongated cone-guide in forward direction relative to the expansion cone.

3. The expansion device according to claim 2, wherein the fluid supply includes a front passage arranged near the front of the annular piston, a rear passage arranged near the rear of the annular piston, and a flow control means for allowing or preventing pressure fluid from flowing through the front or through the rear passage.

4. The expansion device according to claim 3, wherein the elongated cone-guide is a double-walled tube having an annular chamber between the walls of the double-walled tube, wherein the front passage and the rear passage extend through the walls of the double-walled tube, wherein the flow control means comprises a sliding valve arranged in the annular chamber and provided with a valve passage, which sliding valve can be displaced between a front position in which the valve passage is at the position of the front passage and a rear position in which the valve passage is at the position of the rear passage, and wherein the actuator further comprises driving means for displacing the sliding valve between the front position and the rear position.

5. The expansion device according to claim 4, wherein the driving means comprises a releasable spring-loaded pusher arranged an end of the expansion device, wherein the spring of a pusher is loaded by the cylinder approaching the spring-loaded pusher, and wherein the pusher is released by the cylinder being at the pusher.

6. The expansion device according to claim 1, which further comprises a middle anchor joined to the expansion cone, wherein the middle anchor is capable of cooperating with the inner surface of the pipe to prevent movement of the expansion cone relative to the pipe, when, during normal operation, the elongated cone-guide is displaced relative to the expansion cone in the forward direction.

7. The expansion device according to claim 1, further comprising a second retrievable end anchor arranged at the free end of the elongated cone-guide, wherein the end anchor is capable of cooperating with the inner surface of the pipe to prevent movement of the elongated cone-guide relative to the pipe, when, during normal operation, the expansion cone is displaced relative to the elongated cone-guide in the forward direction.

8. An expansion device for expanding a pipe, wherein the expansion device has a front end and a rear end, and wherein the expanding device comprises:

an expansion cone tapering in forward direction towards the front end of the expansion device;

an anchor capable of being selectively anchored to the inner surface of the pipe; and an actuator for moving the expansion cone in forward direction through the pipe, the actuator comprising a first member connected to the expansion cone, a second member axially movable relative to the first member, the second member being connected to the anchor, and hydraulic drive means for axially moving the first and second members relative to each other, wherein the hydraulic drive means is adapted to move the expansion cone in a forward direction through the pipe when the anchor is anchored to the inner surface of the pipe, and wherein the hydraulic drive means is adapted to move the first and second members relative to each other so as to move the anchor in a forward direction through the pipe when the anchor is released from the inner surface of the pipe;

wherein the second member is an elongated cone-guide, wherein the anchor is a retrievable end anchor arranged at one end of the elongated cone-guide which end anchor is capable of cooperating with the inner surface of the pipe to prevent movement of the elongated cone-guide relative to the pipe, when, during normal operation, the expansion cone is displaced relative to the elongated cone-guide in the forward direction, wherein the hydraulic drive means includes an annular piston protruding from the elongated cone-guide, wherein the first member is a cylinder slidingly arranged over the annular piston and having annular sealing rims at either end of the cylinder which define a front chamber and a rear chamber, respectively, and wherein the actuator includes a fluid supply for alternatingly supplying pressure fluid to the front chamber to displace the expansion cone in forward direction relative to the elongated cone-guide and to the rear chamber to displace the elongated cone-guide in forward direction relative to the expansion cone;

wherein the fluid supply includes a front passage arranged near the front of the annular piston, a rear passage arranged near the rear of the annular piston, and a flow control means for allowing or preventing pressure fluid from flowing through the front or through the rear passage; and wherein the elongated cone-guide is a double-walled tube having an annular chamber between the walls of the double-walled tube, wherein the front passage and the rear passage extend through the walls of the double-walled tube, wherein the flow control means comprises a sliding valve arranged in the annular chamber and provided with a valve passage, which sliding valve can be displaced between a front position in which the valve passage is at the position of the front passage and a rear position in which the valve passage is at the position of the rear passage, and wherein the actuator further comprises driving means for displacing the sliding valve between the front position and the rear position.

9. The expansion device according to claim 8, wherein the driving means comprises a releasable spring-loaded pusher arranged an end of the expansion device, wherein the spring of a pusher is loaded by the cylinder approaching the spring-loaded pusher, and wherein the pusher is released by the cylinder being at the pusher.

* * * * *